US007104710B2

(12) United States Patent
Otsuka

(10) Patent No.: US 7,104,710 B2
(45) Date of Patent: Sep. 12, 2006

(54) PRINTING APPARATUS WITH FIRST AND SECOND MEASURING MEANS FOR OBTAINING A CONVEYING AMOUNT OF A PRINTING MEDIUM

(75) Inventor: Naoji Otsuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 10/929,518

(22) Filed: Aug. 31, 2004

(65) Prior Publication Data

US 2005/0053408 A1 Mar. 10, 2005

(30) Foreign Application Priority Data

Sep. 5, 2003 (JP) ..... 2003-314428

(51) Int. Cl.
*B41J 11/36* (2006.01)
*B41J 11/00* (2006.01)

(52) U.S. Cl. ..... 400/76; 400/572; 400/634

(58) Field of Classification Search ..... None
See application file for complete search history.

(56) References Cited

U.S. PATENT DOCUMENTS

| | | | | |
|---|---|---|---|---|
| 6,371,592 | B1 | 4/2002 | Otsuka et al. | 347/19 |
| 6,497,468 | B1 | 12/2002 | Otsuka | 347/16 |
| 6,599,042 | B1 * | 7/2003 | Wolf | 400/582 |
| 6,599,043 | B1 | 7/2003 | Kobayashi et al. | 400/582 |
| 6,702,274 | B1 | 3/2004 | Otsuka | 271/10.01 |
| 6,702,492 | B1 | 3/2004 | Saito | 400/582 |
| 6,846,058 | B1 * | 1/2005 | Claramunt et al. | 347/16 |
| 2002/0051028 | A1 | 5/2002 | Kobayashi et al. | 347/19 |
| 2002/0051670 | A1 | 5/2002 | Saito | 400/625 |

FOREIGN PATENT DOCUMENTS

| | | |
|---|---|---|
| JP | 2002-128313 | 5/2002 |
| JP | 2002-137469 | 5/2002 |

* cited by examiner

*Primary Examiner*—Daniel J. Colilla
(74) *Attorney, Agent, or Firm*—Fitzpatrick, Cella, Harper & Scinto

(57) ABSTRACT

A printing medium is conveyed at a high speed and high accuracy by reducing the conveyance error of a conveyor roller as much as possible. For this purpose, the printing apparatus includes first measuring unit for obtaining a conveying amount of said printing medium by measuring a rotational amount of the conveyor roller, second measuring unit for obtaining a conveying amount of the printing medium by directly detecting a moving amount of the printing medium, and control conveying operation by using both of output values obtained from the first measuring unit and the second measuring unit. Thereby, it is possible to correct the output value from the first measuring unit by the output value from the second measuring unit, as well as to switch the output value used for the conveyance control between both the output values.

18 Claims, 11 Drawing Sheets

PRINTING APPARATUS WITH FIRST AND SECOND MEASURING MEANS FOR OBTAINING A CONVEYING AMOUNT OF A PRINTING MEDIUM

BACKGROUND OF THE INVENTION

1. Field of the Invention

The present invention relates to a printing apparatus, particularly to a technique for driving a mechanism for feeding or conveying a printing medium at a high speed and a high accuracy.

2. Description of the Related Art

There have been various proposals for facilitating the conveyance accuracy of the printing medium in the printing apparatus for forming an image by printing means while conveying the printing medium through the interior of the printing apparatus (for example, see Japanese Patent Application Laid-open No. 2002-28313). Recently, means for detecting a present position of the printing medium and controlling the conveying speed of the printing medium by using the detected content becomes an indispensable component for forming the image at an aimed position on the printing medium (for example, see Japanese Patent Application Laid-open No. 2002-137469). A conventional method for controlling the conveyance of the printing medium will be described below.

FIG. 1 is a schematic view for explaining a main part of a conveyor system in the prior art printing apparatus. In the drawing, reference numeral 1001 denotes a first conveyor roller, and 1002 denotes a second conveyor roller. Also, reference numeral 1003 denotes a first pinch roller corresponding to the first conveyor roller 1001, and 1004 denotes a second pinch roller corresponding to the second conveyor roller 1002. The conveyor rollers 1001 and 1002 convey a printing medium 1007 in the direction indicated by an arrow, while nipping the printing medium 1007 between them and pinch rollers 1003 and 1004 thereof, respectively. Reference numeral 1008 denotes a conveyor motor. The conveyor rollers 1001 and 1002 are made to rotate by the engagement thereof with a drive shaft of the conveyor motor 1008. An image is printed in an area of the conveyed printing medium 1007 between the two conveyor rollers 1001 and 1002 by a head cartridge 1 mounted to a carriage 2.

A rotational angle sensor 1006 and a code wheel 1005 constitute means for detecting a conveying distance and a conveying speed of the printing medium. The code wheel 1005 is fixed to a rotary shaft of the first conveyor roller 1001. While, the code wheel 1005 is provided with slits cut at a constant pitch in the circumferential end portion thereof. A position of the respective slit can be detected by the rotational angle sensor 1006 fixedly disposed within the printing apparatus.

FIG. 2 is an enlarged view illustrating the detection of the slits 201 on the code wheel 1005 by the rotational angle sensor 1006. The slits 201 are cut on the code wheel 1005 at a constant pitch. The rotational angle sensor 1006 is a transparent type optical sensor for detecting the moving slit 201 and issuing a pulse signal at a timing of detection. The rotational angle of the code wheel 1005 is detected by the issued pulse signal. The position, speed and acceleration of the printing medium 1007 are calculated by the rotational angle, the time interval for issuing the pulse signals, or others. Further, by using the value thus obtained, it is possible to control the rotational speed or others of the conveyor roller 1001.

FIG. 3 is an illustration for explaining a conventional profile for controlling the conveyance of the printing medium. In the drawing, an abscissa axis represents a time passage. Curve of a represents a distance from the detected point of the printing medium to a target point. And curve of b represents the conveying speed of the printing medium. In general, as illustrated, when the position of the printing medium is far from the target point, the conveying speed is accelerated for a predetermined period, maintained at a constant speed, and then decelerated when approaching to the target point. Finally, the printing medium is controlled to stop at the target point.

In the conventional printing apparatus, the conveyance of the printing medium is controlled as described above. When it is necessary to control the conveyance of the printing medium at a higher speed and a higher accuracy, the technique has been improved to facilitate the accuracy of the mechanical dimension of the first conveyor roller for conveying the printing medium and to control the rotational angle of the first conveyor roller at a higher speed and a higher accuracy.

Recently, however, the requirement has been more complicated, for example, when a high grade image having a photographic image quality is printed by using ink droplets of a micro-size ejected at a higher density and a higher accuracy. Under such a circumstances, it is necessary to rapidly improve the conveyance accuracy of the printing medium, whereby there has been a limit in the conventional mechanism and the prior art control method.

For example, if the conveying speed is extremely decelerated, there is a problem in that an output from the rotational angle sensor 1006 becomes discrete to make the speed control to be very difficult. Concretely, by the speed deceleration, a mechanical frictional load or others may vary whereby a pulse signal necessary for obtaining an actual speed becomes discrete while containing errors. Accordingly, the speed control carried out in accordance with this pulse signal is liable to be unstable. To avoid this problem, there is a method for facilitating the resolution of the slit 201 in the code wheel 1005. However, this is limitative in practice in the manufacture of the code wheel. As an alternative method for facilitating the resolution, a diameter; i.e., a circumferential length; of the code wheel may be enlarged to increase the number of slits. This method, however, is problematic because a size of the printing apparatus itself becomes larger.

Also, the eccentricity during the attachment of the code wheel 1005 and the conveyor roller 1001 is problematic, and not negligible when the control is more precisely carried out.

In addition, there is another problem in the accuracy of the stop position. If it is required to stop the printing medium at the accuracy higher than the resolution of the code wheel 1005, a true position could not be known between the adjacent two slits. Thereby the printing medium is made to stop based on the presumption. In such a case, there is a risk in that the stop position may fluctuate relative to the presumed position due to the variation of the mechanical frictional load or others.

Further, the conveying distance obtained by the conventional system is a calculated value indirectly obtained from the rotational angle of the code wheel 1005, which is not directly resulted from the measured distance of the printing medium 1007. Accordingly, all errors becomes the error of the conveying distance, such as a dimensional error or attachment error of the parts disposed downstream from the code wheel 1005 or a slippage due to the difference in friction between the printing medium 1007 and the pinch roller.

Drawbacks will be described below, which may occur when the prior art method having the above-mentioned problems is used for controlling the printing medium under the recent circumstances.

1) Recently, there are various printing media or others to be conveyed, such as a plain paper, a coated paper, a glossy paper or a plastic tray for the CD-R printing. Accordingly, a surface property of the printing medium or an object to be conveyed, such as a coefficient of friction may be widely changed to result in various frictional forces between the object to be conveyed and the conveying roller. Thus, the actual conveying distance is variable relative to the same rotational angle of the conveyor roller in accordance with kinds of the conveyed object, whereby there is a problem in that the accurate conveying distance is not obtainable by solely controlling the rotational angle of the conveyor roller.

2) A gear or an encoder used for controlling a gear driving the conveyor system has a slight eccentricity or deflection. Thereby, the actual conveying distance more or less contains an error of the above-mentioned mechanical system even if the rotational angle is correctly controlled by using the sensor. This error is not negligible in the high conveying accuracy required for the recent printing apparatus.

3) In the conventional system for converting the value obtained from the rotational angle sensor to the conveying distance of the printing medium, a diameter of the wheel which is a scale of the rotational angle sensor may be increased for the purpose of further enhancing the resolution of the detectable rotational angle. In this case, however, since a size of the wheel is directly related to a size of the printing apparatus, the enlargement of the wheel size must be naturally limited under the recent circumstances in which the minimization of an apparatus size is important. Accordingly, there is also a limitation in the improvement in the resolution of the rotational angle; i.e., the conveyance accuracy.

4) Nowadays, the requirement for a so-called full-bleed printing has increased, in which the printing is carried out until reaching the endmost edge of the printing medium. When the endmost edge of the printing medium is printed in this system, there is a stage in which the printing medium is left from the first conveyor roller and is conveyed solely by the second conveyor roller. A slight error in the conveyance performance inevitably exists between the first and second conveyor rollers due to the difference in the mechanical transmission passage. This problematic in that such an error results in the shift of the printing position in the printing of the rear end portion and causes a significant drawback of the image. In the recent full-bleed printing, a countermeasure therefor is adopted by minimizing a length of the printing medium to be once conveyed to suppress the mechanical error. However, such a countermeasure causes a novel problem in that the printing speed becomes lower.

SUMMARY OF THE INVENTION

The present invention has been made to solve the above-mentioned various problems, and an object thereof is to eliminate the conveyance error of the conveyor roller as much as possible and realize the high-accuracy and high-speed conveyance of the printing medium.

In an aspect of the present invention, there is provided a printing apparatus for carrying out the printing on a printing medium by using a printing head, comprising: conveying means for conveying the printing medium; first measuring means for obtaining a conveying amount of the printing medium by measuring a driving amount of the conveying means; second measuring means for obtaining a conveying amount of the printing medium by directly detecting a moving amount of the printing medium; and control means for controlling the conveying means by using both of output values obtained from the first measuring means and the second measuring means.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Figure 1:
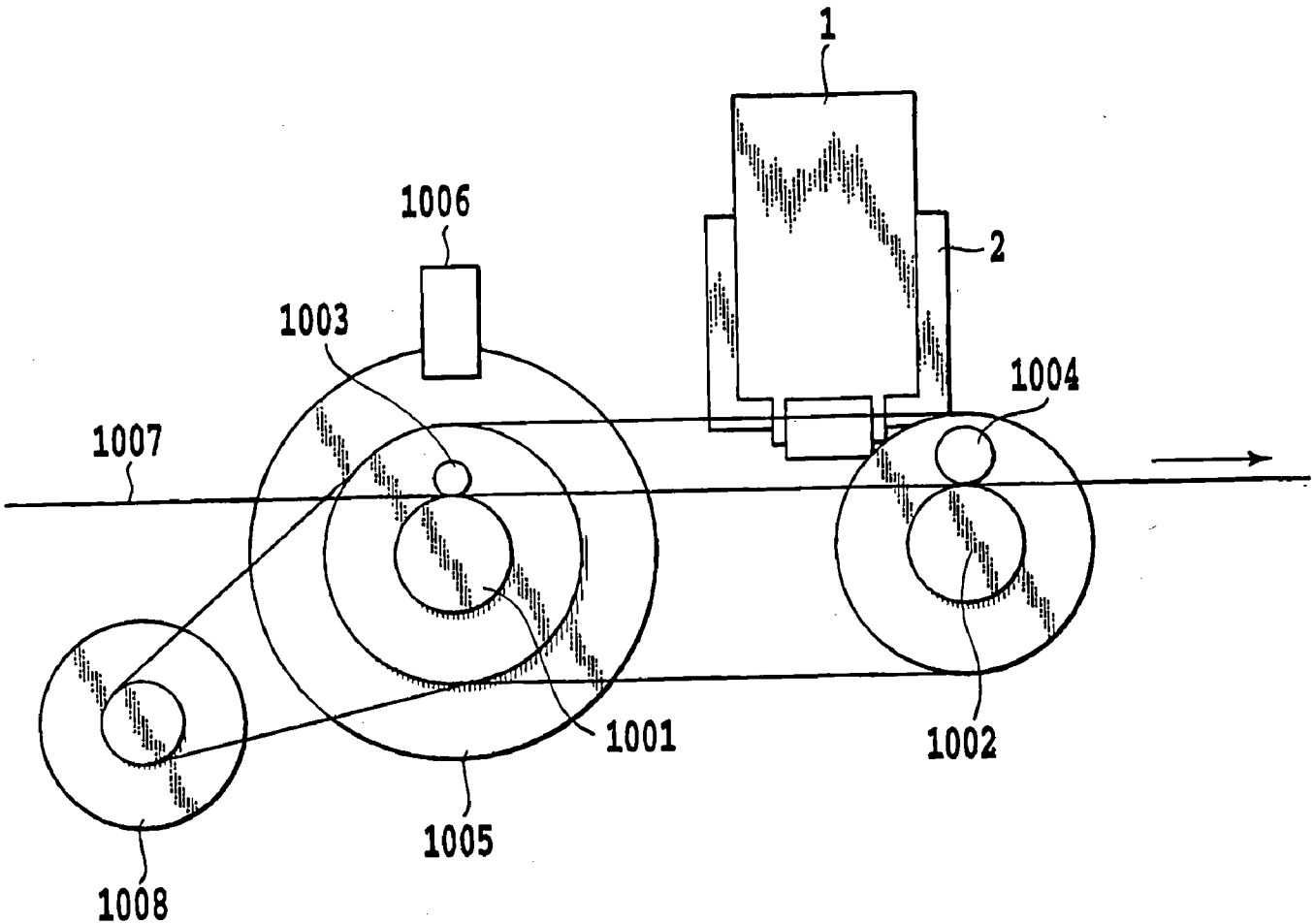
FIG.1 PRIOR ART
FIG. 1 is a schematic view for illustrating a main part of a conveyor system for a prior art printing apparatus.
Figure 2:
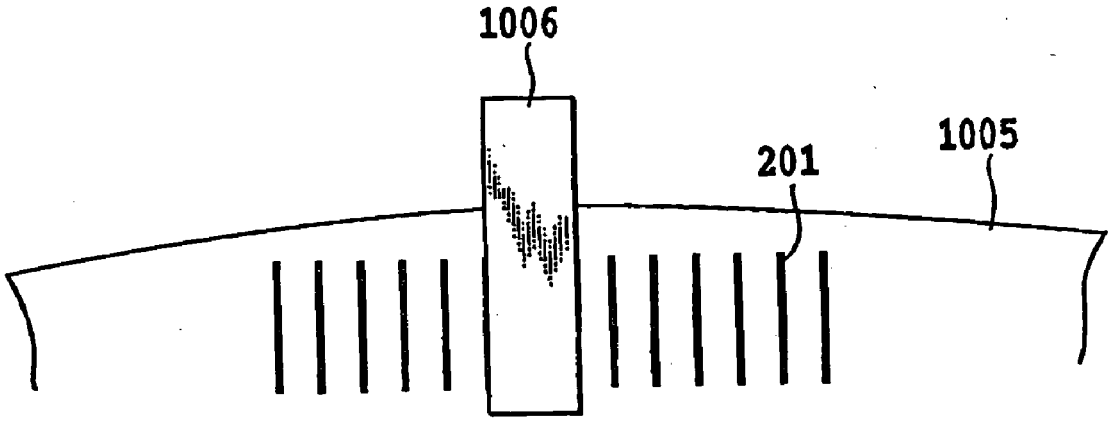
FIG.2 PRIOR ART
FIG. 2 is an enlarged view for illustrating a rotational angle sensor and a code wheel.
Figure 3:
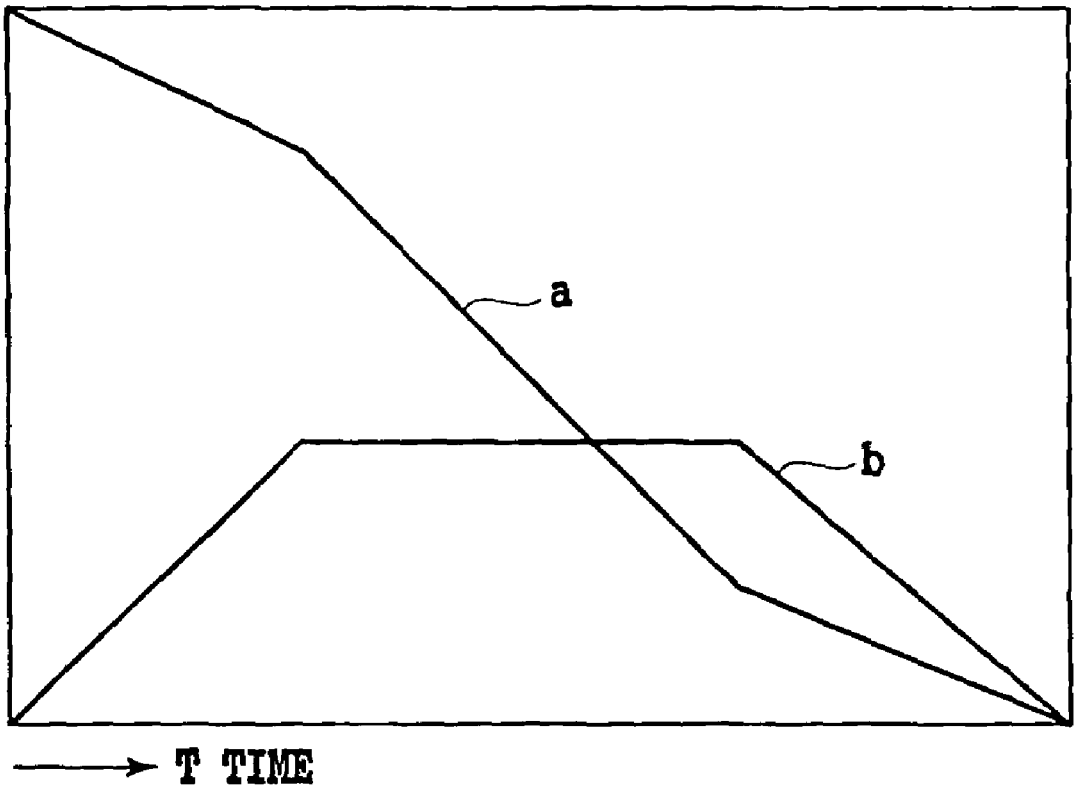
FIG.3 PRIOR ART
FIG. 3 is a graph for illustrating a conventional control profile of conveyance of a printing medium.

In this text, a term "printing" stands for not only the formation of significant information such as characters or figures but also the formation of significant or insignificant images or patterns on a printing medium, irrespective of being actualized to be visible by human eyes. Also, this term may includes the treatment of the medium.

The printing medium (hereinafter also referred to as a sheet material) used in this text is not only paper sheet used in the conventional printing apparatus but also all ink-receivable articles such as cloth, plastic film or metallic plate.

The ink should be widely translated as in the above-described definition of the printing, and includes all liquids usable for forming images and patterns on the printing medium or treating the printing medium.

The present invention will be described in detail below based on the preferred embodiments with reference to the attached drawings, wherein elements denoted by the same reference numerals are identical or correspond to each other.

Figure 4:
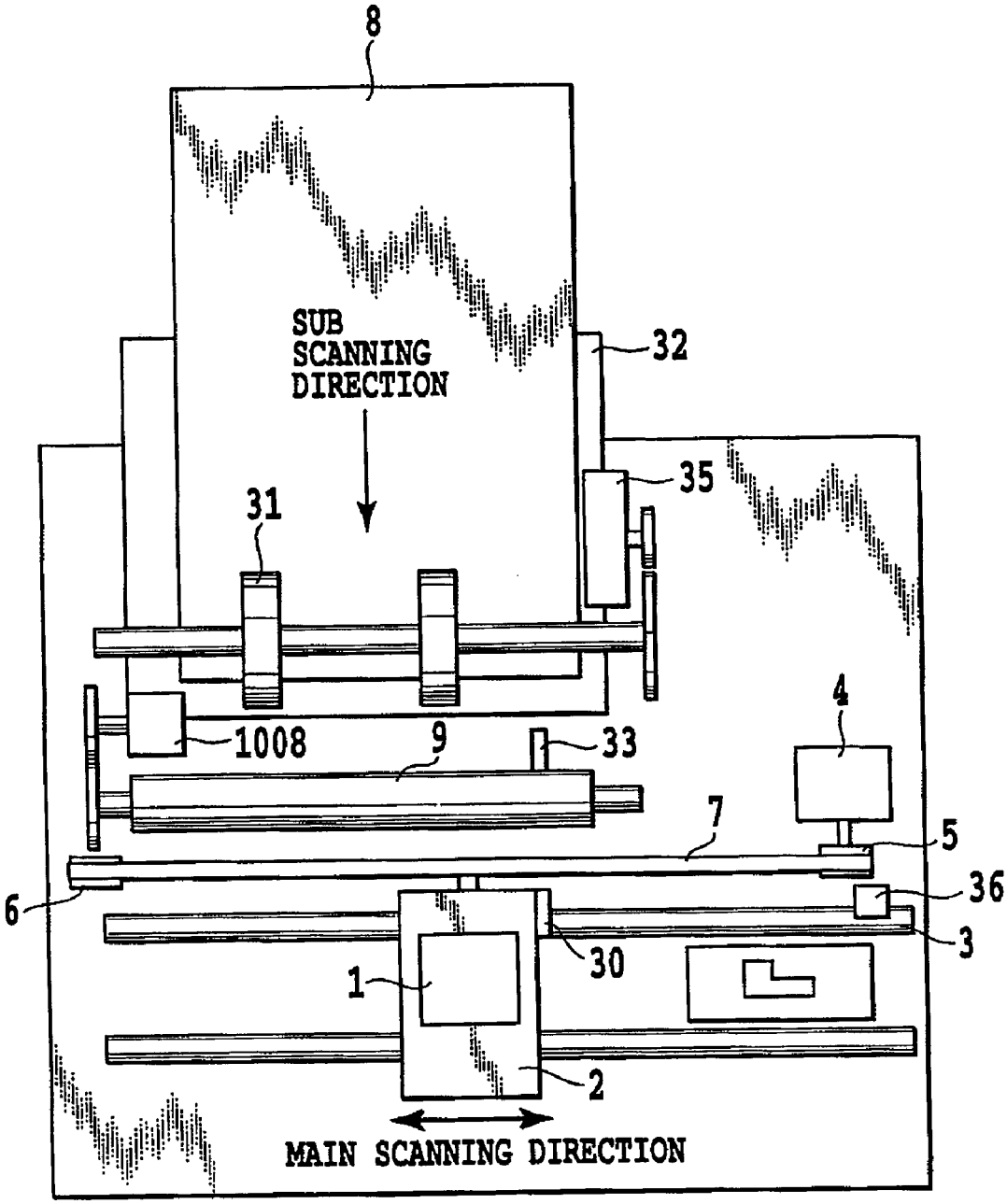
FIG. 4 is a schematic view for illustrating a structure of a main part of an ink-jet printing apparatus according to the present invention.

FIG. 4 is a schematic view for illustrating a structure of a main part of an ink-jet printing apparatus according to the present invention. In FIG. 4, a head cartridge 1 is detachably mounted to a carriage 2. The head cartridge 1 includes a printing head section having a plurality of printing elements for ejecting inks as droplets and ink tanks for supplying the inks to the respective printing elements.

In addition, the head cartridge 1 is provided with a connector for transmitting/receiving signals or others for driving the printing head section. The carriage 2 is provided with a connector holder for transmitting drive signals or others to the head cartridge 1 via the connector.

Reference numeral 3 denotes a guide shaft provided in a main body of the printing apparatus. The carriage 2 is guided and held by the guide shaft 3 and is capable of the reciprocating in the main scanning direction in the drawing along the guide shaft 3. The motion of the carriage 2 is derived from a main scanning motor 4 via a drive mechanism including a motor pulley 5, a driven pulley 6, a timing belt 7 or others. At the same time, a position and a traveling distance of the carriage 2 are also controlled.

The carriage 2 is further provided with a home-position sensor 30. The home-position sensor 30 is capable of knowing that the carriage 2 is at a home position when the home-position sensor 30 passes by a shield plate 36.

Prior to the printing, sheet material 8 such as printing media or plastic sheets are placed on an auto sheet feeder 32. Upon the beginning of the printing operation, a paper-feed motor 35 is made to start, which driving force is transmitted to a pickup roller 31 via gears. Thereby, the pickup roller 31 rotates to separate the sheet material 8 one by one from the auto sheet feeder 32 and feed the same into the printing apparatus.

Subsequently, the sheet material 8 is conveyed in the subsidiary scanning direction at a predetermined speed by the rotation of the conveyor roller 9 to pass through a position opposite to an ejection-orifice surface of the head cartridge 1. The conveyor roller 9 is driven to rotate by the conveyor motor 1008 via gears. While not illustrated in the drawing, a second conveyor roller is provided separately from the first conveyor roller 9 further downstream from the carriage. The second conveyor roller rotates together with the first conveyor roller to convey the sheet material 8.

The head cartridge 1 carried on the carriage 2 has an ejection-orifice surface protruded downward from the carriage 2 and is held between the above-mentioned two pairs of conveyor rollers to be parallel to the sheet material 8. A rear surface of the sheet material 8 is supported by a platen (not shown) so that a flat printing surface is maintained in the printing section. The head cartridge 1 ejects ink to the sheet material 8 in accordance with predetermined image signals when the sheet material 8 passes through the under side of the head cartridge 1.

Reference numeral 33 denotes a paper-end sensor for detecting whether or not there is the sheet material 8. It is possible to know by the output from the paper-end sensor 33 whether or not the sheet material 8 is normally fed. The timing of detecting a frontal end of the sheet material 8 by the paper-end sensor 33 is used for setting for starting position of printing on the sheet material 8. Also, by detecting a rear end of the sheet material 8 by the paper-end sensor 33 at a final stage of the printing operation, it is possible to confirm the rear end position in the printing carried out after the detection and to forecast a position of the printing now being carried out on the sheet material.

The head cartridge 1 used in this embodiment is of an ink-jet type for ejecting ink by using heat energy, and therefore a plurality of electro-thermal transducers are provided for generating heat. Specifically, heat energy is generated by a pulse signal applied to the electro-thermal transducer to generate the film boiling in the ink liquid. The bubbling pressure due to the film boiling is used for ejecting ink from the ejection orifice for the purpose of printing.

Figure 5:
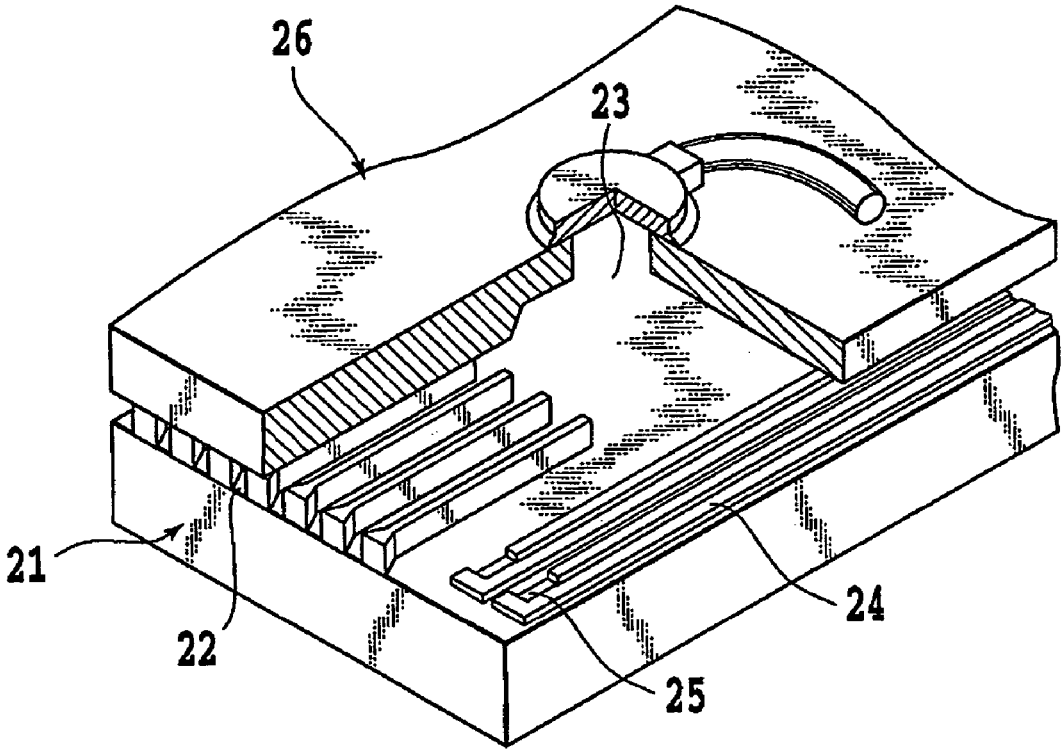
FIG. 5 is a schematic perspective view for partially illustrating a structure of a main part of a printing head in a head cartridge used for an embodiment of the present invention.

FIG. 5 is a schematic perspective view for partially illustrating a structure of a main part of a printing head 26 in a head cartridge 1 used for an embodiment of the present invention.

In FIG. 5, on an ejection orifice surface 21 opposite to the sheet material 8 at a predetermined distance (for example, approximately 0.5 to 2.0 mm), a plurality of ejection orifices 22 are formed at a predetermined pitch. A liquid passage 24 communicating with the respective ejection orifice 22 is formed from a common liquid chamber 23 to guide ink in the common liquid chamber to the respective ejection orifice by the capillary action of the liquid passage 24. An electro-thermal transducer (heat-generating resistor or the like) 25 is provided in the wall surface of the liquid passage 24 for generating the heat energy. A predetermined pulse is applied to the electro-thermal transducer 25 based on an image signal or ejection signal to generate heat which causes the film boiling in ink in the liquid passage 24. A predetermined amount of ink is ejected from the ejection orifice 22 as an ink droplet due to the bubbling pressure generating at this time.

According to this embodiment, a serial type ink-jet printing apparatus is used, wherein the ejection orifices 22 of the head cartridge 1 are arranged in the direction transverse to the scanning direction of the carriage 2. By alternately repeating the main scan in which ink is ejected from the respective ejection orifice 22 while moving the carriage 2 and the subsidiary scan in which the printing medium (sheet material) is moved by a predetermined distance in the direction transverse to the main scanning direction, the image is sequentially formed on the printing medium. In this regard, the present invention should not be limited solely to the serial type printing apparatus.

Figure 6:
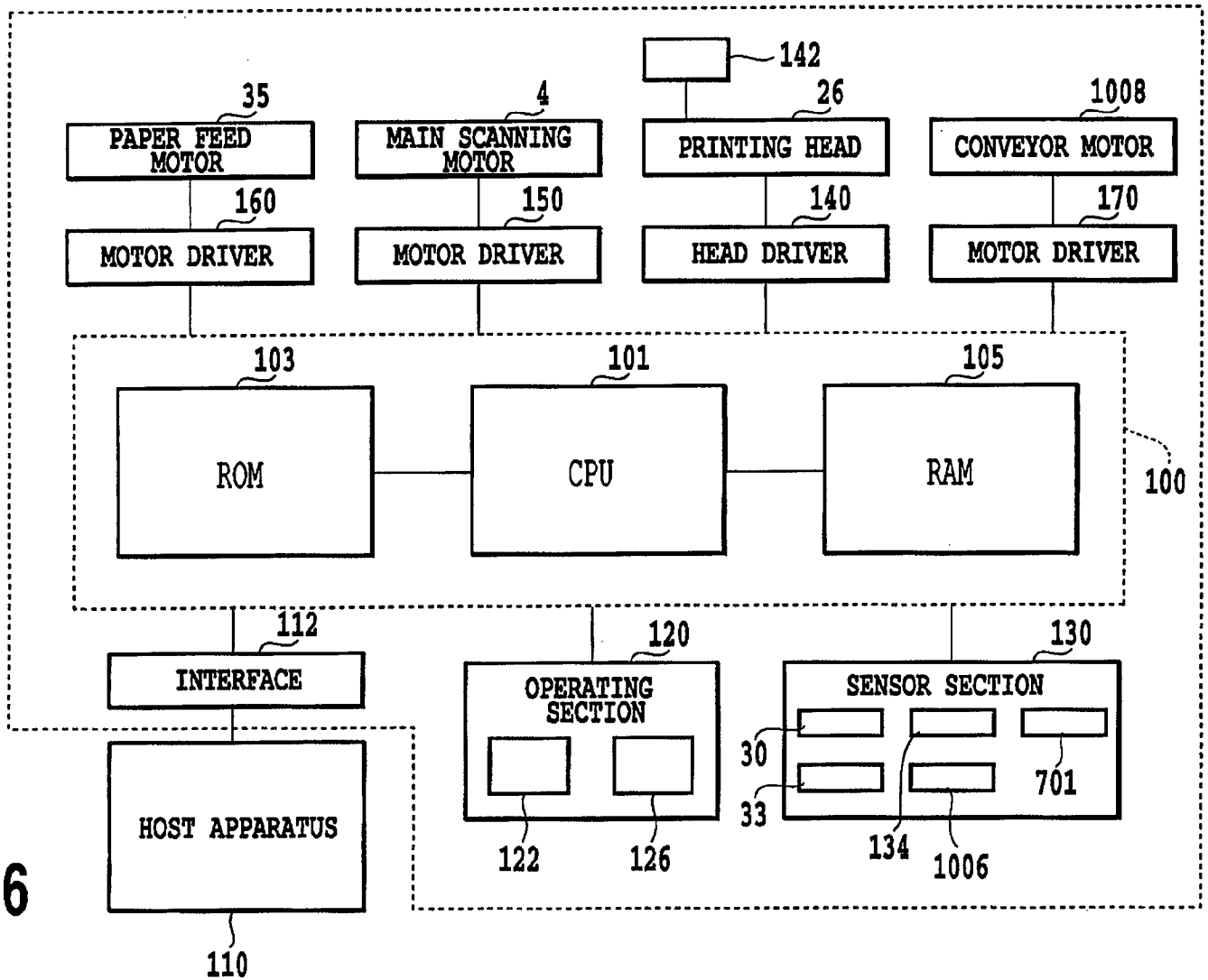
FIG. 6 is a block diagram for illustrating a control system of an ink-jet printing apparatus used for the embodiment of the present invention.

FIG. 6 is a block diagram for illustrating a control system of the ink-jet printing apparatus used for this embodiment. In FIG. 6, a controller 100 is a main control section of the printing apparatus and includes CPU 101 of a microcomputer form, ROM 103 storing solid state data such as programs or necessary tables and RAM 105 provided with an area for developing image data or an operating area.

A host apparatus 110 is a source for supplying images and connected to an external of the printing apparatus. The host apparatus 110 may be a computer for forming image data relating to the printing or carrying out the processing, or a reader for reading images. Image data, commands or status signals supplied from the host apparatus 110 are transmitted to or received by the controller 100 via an interface (I/F) 112.

An operating section 120 is a group of switches for accepting an indication of the operator, including a power source switch 122, a recovery switch 126 or others.

A sensor section 130 is a group of sensors for detecting conditions of the apparatus. In this embodiment, the sensor section 130 includes, in addition to the above-mentioned home-position sensor 30 and paper-end sensor 33, a temperature sensor 134 for detecting the environmental temperature, a rotational angle sensor 1006 and a moving distance reading sensor 701 which is peculiar to the present invention.

Reference numeral 140 denotes a head driver for driving the electro-thermal transducer of the printing head 26 in accordance with printing data. The head driver 140 includes a shift register for arranging the printing data in correspondence to each of the plurality of electro-thermal transducers 25, a latch circuit for latching a suitable timing, a logic circuit element for operating the electro-thermal transducer 25 in synchronism with a drive timing signal, a timing setting section for suitably setting an ejection timing for adjusting the dot-forming position on the printing medium, or others.

In the vicinity of the printing head 26, there is a sub-heater 142. The sub-heater 142 carries out the temperature adjustment of the printing head for stabilizing the ejection characteristic of ink. The sub-heater 142 may be formed on a substrate of the printing head 26 similar to the electro-thermal transducer 25, or may be attached to a body of the printing head 26 or the head cartridge 1.

Reference numeral 150 denotes a motor driver for driving the main scanning motor 4, and 170 denotes a motor driver for driving the conveyor motor 1008. By the action of the main scanning motor 4, the carriage 2 is movable in the main scanning direction, and by the action of the conveyor motor 4, the sheet material 8 is conveyed in the subsidiary scanning direction.

Reference numeral 160 denotes a motor driver for driving the paper-feed motor 35. By the action of the paper-feed motor 35, the sheet material 8 is separated from the auto-sheet feeder 32 and fed into the printing apparatus.

Figure 7:
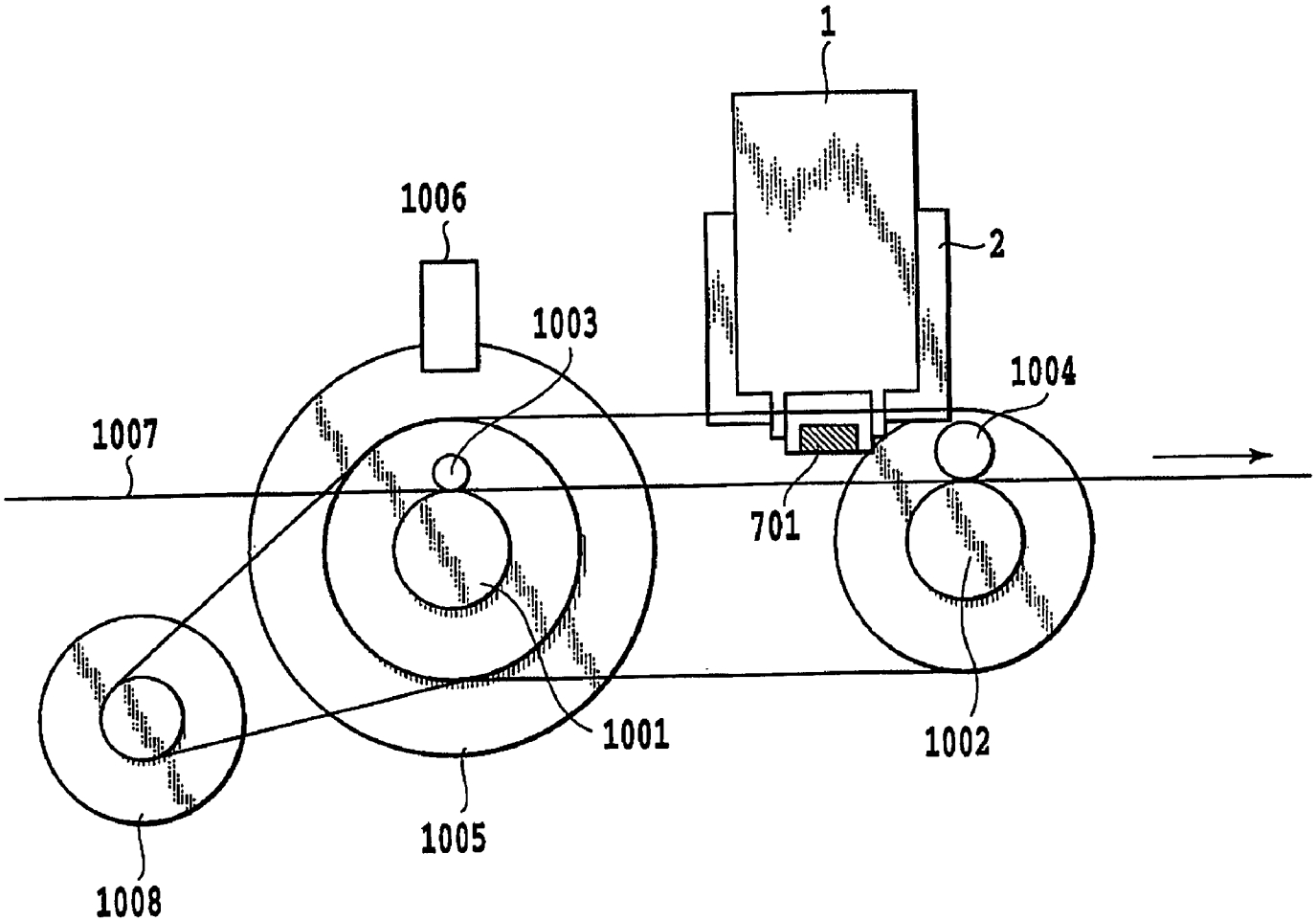
FIG. 7 is a schematic view for illustrating a main structure of a conveyor system which is one of the most characteristic features of the present invention.

FIG. 7 is a schematic view for illustrating a main structure of a conveyor system which is one of the most characteristic features of the present invention.

In this embodiment, the moving distance reading sensor 701 capable of directly reading the moving distance of the printing medium 1007 is provided at a position downstream from the first conveyor roller 1001 in the prior art printing apparatus described with reference to FIG. 1. An effect of the present invention is obtainable by providing the moving distance reading sensor 701 at a position between both the rollers. For this purpose, in this embodiment, the moving distance reading sensor 701 is disposed on a side surface of the carriage 2 in the vicinity of the ejection orifice in the head cartridge 1. As another embodiment, the moving distance reading sensor 701 may be disposed at a position opposite to the ejection orifice surface of the head cartridge 1 so that the printing medium is detected from the rear surface side.

Figure 8:
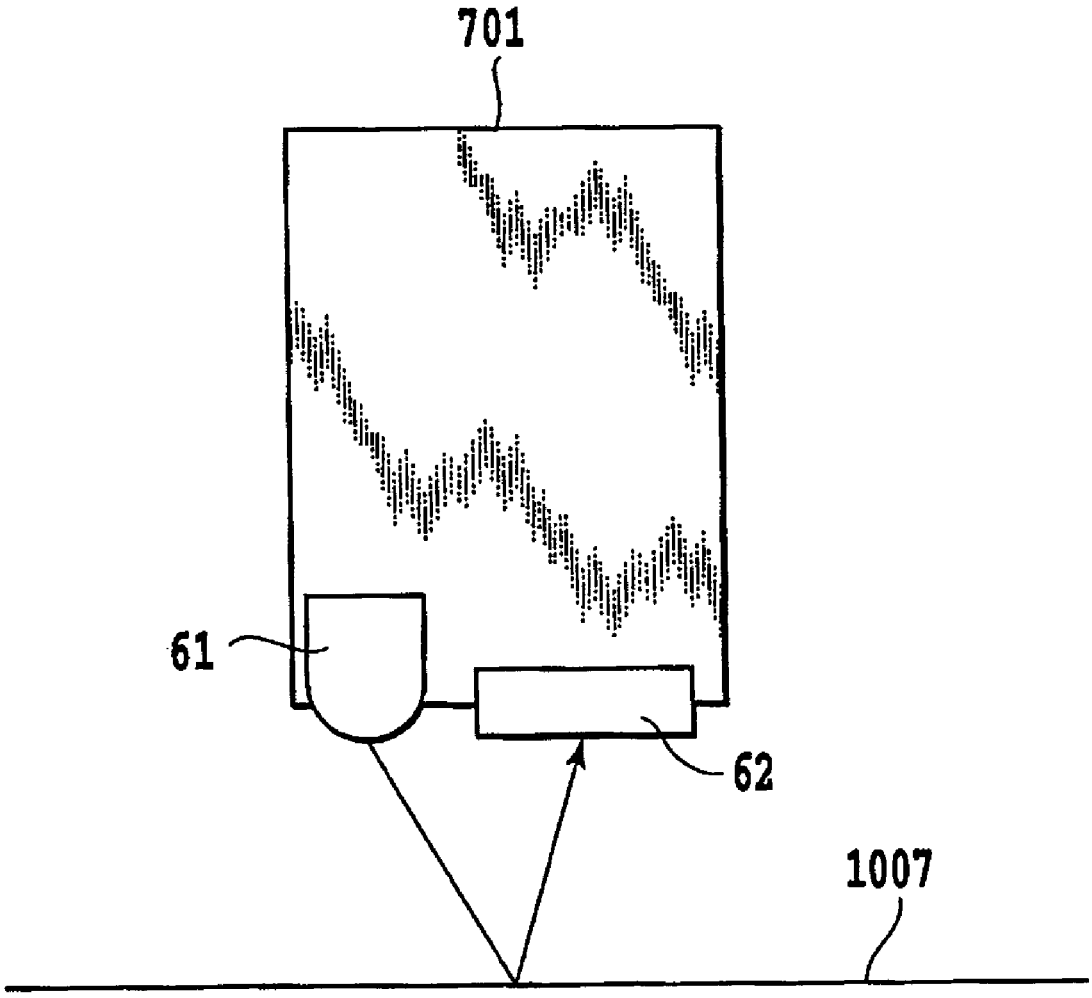
FIG. 8 is an enlarged view for illustrating a structure of a moving distance reading sensor.

FIG. 8 is an enlarged view for illustrating a structure of the moving distance reading sensor 701. In the drawing, the moving distance reading sensor 701 is provided with an LED 61 which is a light source and a light-receiving section 62. The light-receiving section 62 may be a line sensor formed of a plurality of linearly arranged light-receiving elements or an area sensor formed of a plurality of two-dimensionally arranged light-receiving elements. Also, as the light-receiving element, CCD or CMOS may be used.

The operation principle will be described below. LED 61 emits a light beam to the moving printing medium 1007, and the light-receiving section 62 receives a reflected beam thereof at a predetermined time interval. The image processing is carried out on data received by the light-receiving section 62 at the respective timing to extract a feature thereof, so that a shift distance of the respective image from the preceding event.

Various methods may be adopted for extracting the feature of the image. For example, a method may be adopted in which Fourier-transforming used to check the coincidence of profiles thereof. Alternatively, another method may be adopted in which a portion to be a peak is solely extracted and a shift amount of a position thereof is obtained. Further, a method is also popular in which the obtained image is binary-digitized and patterns resulted from the binary-digitization are coincided with each other. In either of the methods, it is possible to determine an instantaneous speed from the moving distance per unit time thus obtained or calculate a value of the acceleration from the change between the succeeding two speeds.

By using such a reflection type optical sensor, it is possible to measure a speed or a moving distance per unit time. This is far different from a case in which the rotational angle sensor is used. Since the rotational angle sensor is means for measuring a time per unit distance, it is difficult to carry out the high accuracy control during the low speed operation. Contrarily, according to this embodiment, it is possible to obtain the conveying speed of the printing medium at a stable accuracy during any speed operation.

Several examples in which the printing apparatus uses the moving-distance reading sensor 701 of this embodiment are described below for proving the effect of the present invention.

EXAMPLE 1

Figure 9:
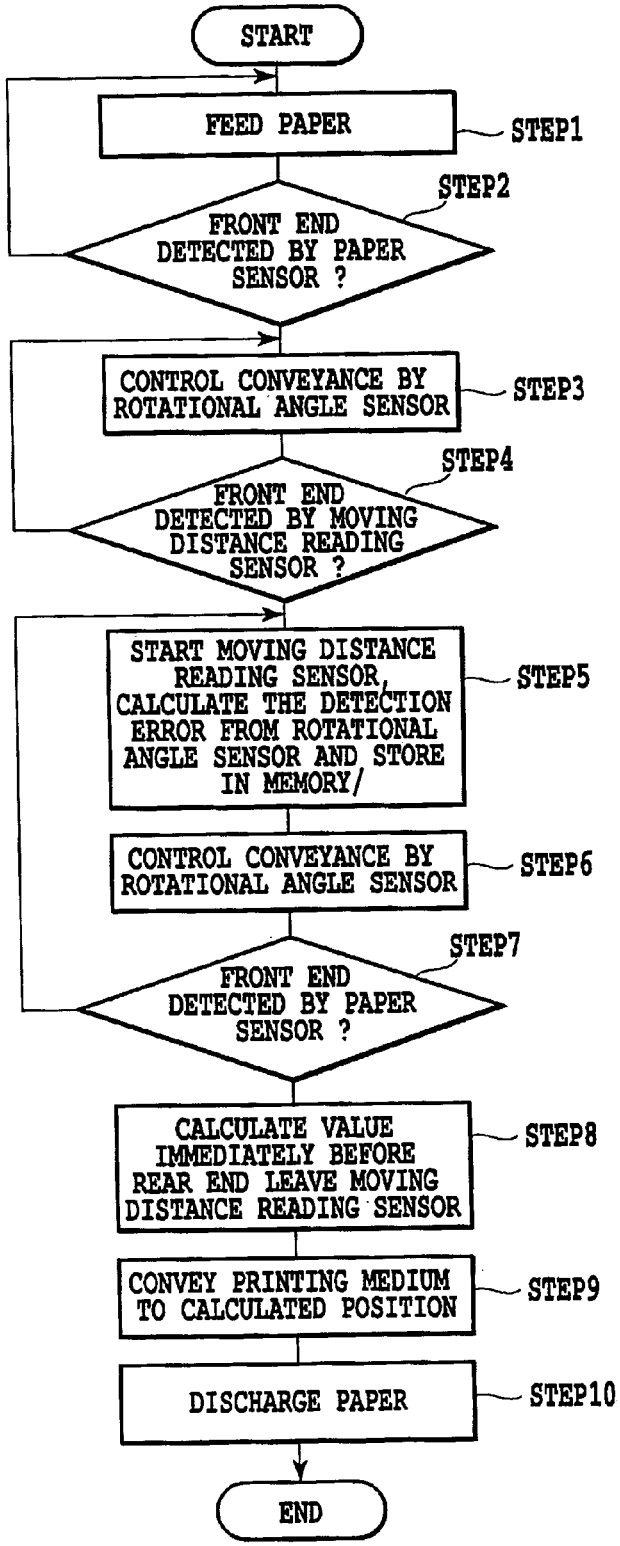
FIG. 9 is a flow chart for illustrating the processing of CPU for controlling the conveyance of a printing medium in Example 1 of the present invention.

FIG. 9 is a flow chart for illustrating the processing of CPU 101 for controlling the conveyance of the printing medium. FIGS. 10A to 10E are illustrations of the conveyance of the printing medium at the respective timing.

With reference to these drawings, upon starting the printing, the supply of the printing medium 1007 is initiated at step 1. The printing medium 1007 is conveyed in the direction indicated by an arrow in FIG. 10A.

At step 2, it is determined whether or not a front end of the printing medium 1007 is detected by the paper-end sensor 33. The supply of the printing medium at step 1 continues until the front end detected at step 2.

When the front end of the printing medium 1007 is detected at step 2, the routine proceeds to step 3 at which the control of a conveying speed and a position is commenced by the rotational angle sensor 1006. This stage corresponds to FIG. 10B.

At step 4, it is determined whether or not the existence of the printing medium 1007 is confirmed by the moving distance reading sensor 701. Until the answer at step 4 is affirmative, the control of the conveying speed and the position continues by the rotational angle sensor 1006 at step 3.

Figure 10A:
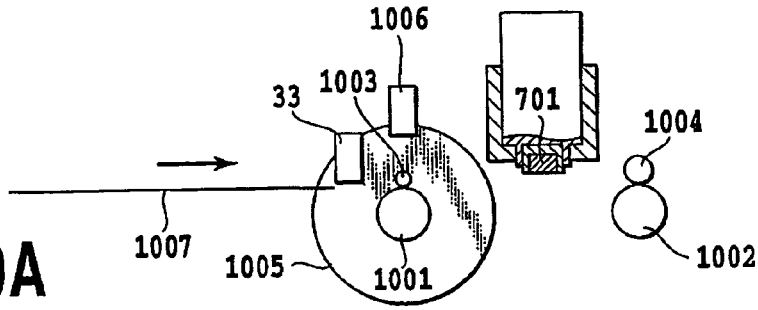
FIGS. 10A to 10E are illustrations of the conveyance of the printing medium at the respective timing.
Figure 10B:
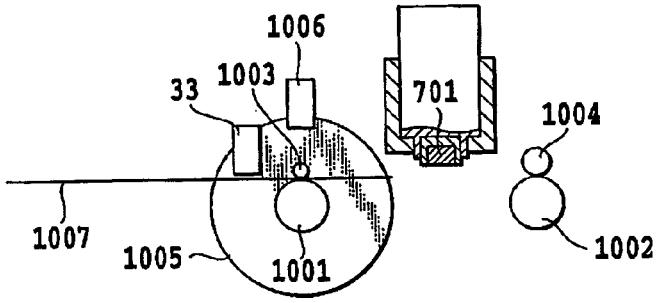
Figure 10C:
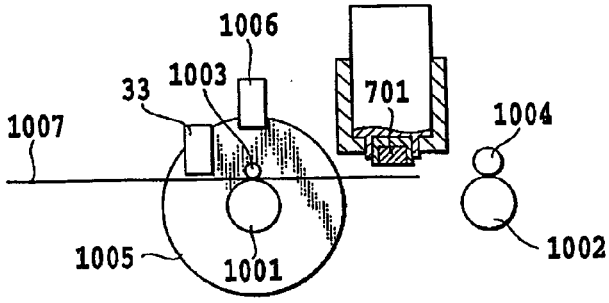

When the existence of the printing medium 1007 is confirmed by the moving distance reading sensor 701 at step 4 as shown in FIG. 10C, the routine proceeds to step 5.

At step 5, the detection of the conveying speed is commenced by the moving distance reading sensor 701. At the same time, an error generated between the rotation of the conveyor roller 1001 and the actual conveying distance is calculated by the difference between a value detected by the rotational angle sensor 1006 and a value detected by the moving distance reading sensor 701. Further, the value thus obtained is stored in a memory in a main body of the printing apparatus in a state so that a kind of the printing medium 1007 is identifiable. When this error is detected, the error detection preferably continues in a distance longer than the circumference of the conveyor roller; i.e., one rotation thereof, if the error is mainly caused by the eccentricity of the conveyor roller. Of course, the error value may be obtained and stored in all the area in which both of the rotational angle sensor 1006 and the moving distance reading sensor 701 is detectable. Further, at step 6, the control of the conveyance continues by the rotational angle sensor 1006.

Figure 10D:
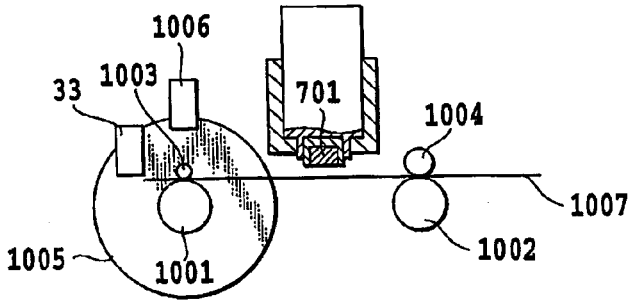
Figure 10E:
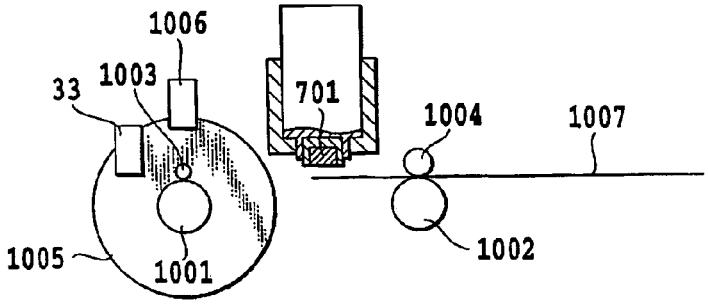
Figure 11:
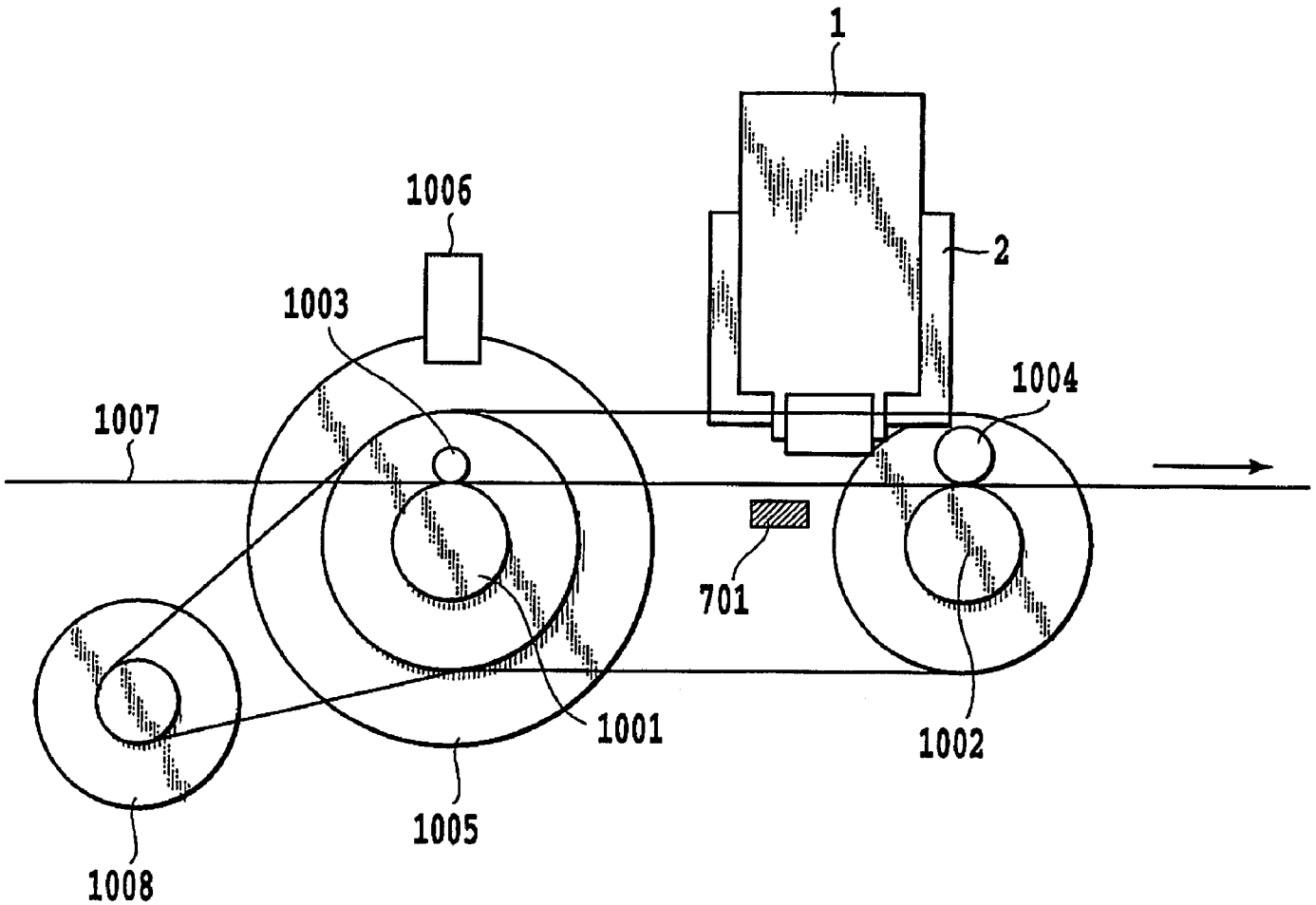
FIG. 11 is a schematic view for illustrating a main structure of another characteristic conveyor system according to the present invention.

When the printing medium 1007 is conveyed to a position shown in FIG. 10D, a rear end of the printing medium 1007 is confirmed at step 7 by the paper-end sensor 33. At step 8, a position of the printing medium 1007 is calculated, at which the rear end thereof is just before departing a detectable range of the moving distance reading sensor 701.

At step 9, the conveyance of the printing medium 1007 continues until the calculated value is reached. When the printing has finished, the printing medium 1007 is discharged at step 10 and this processing is ended.

In this example, the error of the conveying distance by the conveyor roller 1001 is stored in the memory in accordance with kinds of the printing medium. Thereby, it is possible to use the error information stored in the preceding processing if the same kind of printing medium is used in the next processing. Concretely, in an area in which the conveyance control is carried out by the rotational angle sensor, it is possible to correct the conveying distance to the aimed value, by recognizing the conveying distance detected by the rotational angle sensor to be larger (or smaller) by a predetermined amount. In such a manner, it is capable to eliminate the conveyance error as much as possible and to carry out the favorable printing on the printing medium even if it has an optional frictional coefficient.

EXAMPLE 2

In this example, while the conveying distance of the printing medium is corrected in accordance with kinds thereof as described in Example 1, a position of the conveyed printing medium is determined and the printing medium is made to stop at higher accuracy than the resolution of the rotational angle sensor 1006.

The resolution of the moving distance reading sensor 701 used in this example is higher than the resolution of the rotational angle sensor 1006. Accordingly, it is possible to set the conveyance resolution and then the printing resolution at a higher level while maintaining the printing apparatus in a small size without enlarging a diameter of the code wheel 1005 used for the rotational angle sensor 1006.

The actual operation will be described when the conveying distance is larger than a predetermined value, the conveyance control is carried out by the rotational angle sensor 1006 until the conveying distance reaches a value which is closer to the target value but smaller than the latter. At this time, the error between an output from the rotational angle sensor 1006 and the actual conveying distance of the printing medium 1007 may be corrected by using the stored correction value obtained by adopting the method described in Example 1. However, this example should not be limited to the adoption of this method.

After the conveyance in the necessary distance has finished under the control of the rotational angle sensor 1006, the control of the conveyance is switched to the moving distance reading sensor 701 according to this example, so that the printing medium is conveyed in a residual short distance by the moving distance reading sensor 701 having a higher resolution.

EXAMPLE 3

In this example, a control method carried out at a low conveying speed will be described, which is difficult to be controlled by the rotational angle sensor 1006 having a lower resolution, while correcting the conveying distance of the printing medium in accordance with kinds thereof as described in Example 1.

In the rotational angle sensor 1006 outputting a pulse at a timing when the conveyor roller 1001 rotates at predetermined pitches, when the conveying speed; i.e., the roller rotational speed varies, an interval between the adjacent pulses becomes discrete. Even in such a state, it is possible to relatively favorably carry out the algorithm for controlling the speed, if the rotational speed is maintained at a certain level. However, since the rotational speed is considerably lowered immediately before the roller stops at a predetermined position, the control becomes very unstable.

This phenomenon will be described in more detail below. Immediately before the printing medium stops at the predetermined position, the deviation of the positional information of the printing medium becomes small and a value for indicating the speed becomes also small. Accordingly, a power actually supplied to the conveyor motor 1008 is considerably reduced. In this case, if a motor torque lacks, for example, due to the variation of the motor torque or the variation of the friction of individual mechanical systems, the conveying speed may be extraordinarily lowered, which results in the control for increasing the electric power to augment the torque. However, if the conveying speed is very low, the speed information is only discretely obtainable. Thereby, for determining whether or not the speed actually increases, it is necessary to carry out the determination while preventing the oscillation of the control system by setting a rate of upward movement to be very gently sloped. Accordingly, there is a problem in that a time necessary for positioning and stopping the printing medium becomes extremely longer particularly in a low-speed control area.

To solve such a problem, according to this example, when the conveying speed of the printing medium 1007 becomes lower than a predetermined value, the conveyance control is carried out by both of the rotational angle sensor 1006 and the moving distance reading optical sensor 701. Thereby, in the lower speed area, the information having the resolution higher than that of the rotational angle sensor 1006 is obtainable from the moving distance reading optical sensor 701. Accordingly, it is possible to carry out the control in the low speed area in a grade substantially the same as the other area, whereby the above-mentioned problem could be solved.

In this example, the rotational angle sensor which sampling frequency does not fall even in the high-speed conveyance is used in the top conveying speed area. Thereby, even if the sampling is impossible at a responsive speed by the moving distance reading optical sensor 701, it is possible to ensure the stable sampling. On the other hand, the moving distance reading optical sensor 701 is used for controlling the conveyance so that the sampling is always made at a predetermined frequency. By adopting such a structure, it is possible to extremely minimize the deviation from the aimed position. Thereby, it is possible to properly control the motor torque even in a low-speed control so that the printing medium is made to stop at the aimed position in a relatively short period.

While a timing for transferring the control from the rotational angle sensor to the moving distance reading sensor may be an instant at which the conveying speed is lowered below a predetermined value, it is possible to control all the conveyance area by the moving distance reading sensor if the conveying speed is within a speed range in which the response of the moving distance reading sensor is in time.

Alternatively, solely the speed control may be carried out by using the detected value from the moving distance reading sensor. If the positional accuracy is sufficiently obtained by the rotational angle sensor, the moving distance reading sensor may be used while solely applying the effectiveness thereof in the speed control described above so that the position is more rapidly decided.

Also in this example, it is possible to correct the error between the output from the rotational angle sensor 1006 and the actual conveying distance of the printing medium 1007 by using the correction value stored by adopting the method described in Example 1. In this regard, this example should not be limited thereto.

EXAMPLE 4

This example may be carried out independently from or simultaneously with any of the above-mentioned Examples 1 to 3. AND this example is carried out the printing operation when the rear end of the printing medium departs from the first conveyor roller and conveyed solely by the second conveyor roller.

Also in this example, the conveyance of the printing medium 1007 is controlled by switching the detection of the printing medium 1007 from the rotational angle sensor 1006 to the moving distance reading sensor 701 at a predetermined timing. Generally speaking, the timing for switching the control is preferably at an instant immediately before the printing medium is separated from the first conveyor roller after the rear end of the printing medium 1007 has been detected by the paper-end sensor 33 and then conveyed by a certain distance. However, this example should not be limited to be switched at this timing.

Since the first and second conveyor rollers are different in components thereof from each other, an error is more or less generated in the conveyance accuracy of the both. Accordingly, under the condition in which the printing medium 1007 is conveyed solely by the second conveyor roller after the rear end thereof has passed through the first pinch roller 1003, the conveyance accuracy is liable to be unstable in comparison with the conveyance by both the conveyor rollers.

Even in such a state, according to this example, it is possible to assuredly convey the printing medium solely by the second conveyor roller even to the rear end thereof without degrading the accuracy, while controlling the conveyance by means of the moving distance reading sensor having a higher accuracy. After the printing has continued to the rearmost end of the printing medium such as in the full-bleed printing, it is possible to quickly discharge the printing medium by switching the sensor again to the rotational angle sensor to rotate the second conveyor roller.

As described hereinabove, according to the present invention, it is possible to correct an output value obtained from a first conveying amount measuring means by an output value obtained from a second conveying amount measuring means. If necessary, it is possible to switch the output value used for controlling the conveyance from one to the other. Thereby, a high-speed and high-accuracy conveyance of a printing medium is obtainable.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2003-314428 filed Sep. 5, 2003, which is hereby incorporated by reference herein.

What is claimed is:

1. A printing apparatus for carrying out the printing on a printing medium by using a printing head, comprising:

conveying means for conveying the printing medium;

first measuring means for obtaining a conveying amount of the printing medium by measuring a rotational amount of said conveying means;

second measuring means for obtaining a conveying amount of the printing medium by directly detecting a moving amount of the printing medium; and control means for controlling said conveying means by using both of output values obtained from said first measuring means and said second measuring means, wherein said control means (i) includes calculating means for calculating a correction value for a value obtained from said first measuring means by using a value obtained from said second measuring means and memory means for storing the correction value, and (ii) controls said conveying means by using the stored correction value.

2. A printing apparatus as defined by claim 1, wherein said conveying means has a conveyor roller for conveying the printing medium in correspondence with the rotation thereof, and said first measuring means has means for detecting a rotational amount of said conveyor roller.

3. A printing apparatus as defined by claim 1, wherein said second measuring means is an optical sensor having a light receiving section formed of a plurality of one- or two-dimensionally arranged light-receiving elements for receiving light beams reflected from the printing medium.

4. A printing apparatus as defined by claim 3, wherein said light-receiving section is composed of CCD or CMOS.

5. A printing apparatus as defined by claim 1, wherein the measurement by said second conveying-amount measuring means is carried out at a constant time interval.

6. A printing apparatus as defined by claim 1, wherein said memory means is capable of storing the correction value in accordance a type of the printing medium.

7. A printing apparatus as defined by claim 1, wherein the resolution of said second measuring means is higher than that of said first measuring means, and said control means controls said conveying means at a positional accuracy higher than an accuracy obtained by said first measuring means.

8. A printing apparatus as defined by claim 7, wherein said control means controls said conveying means based on a value obtained from said second measuring means when the conveyance control at a positional accuracy higher than the accuracy obtained by said first measuring means is necessary.

9. A printing apparatus for carrying out the printing on a printing medium by using a printing head, comprising:

conveying means for conveying the printing medium;

first measuring means for obtaining a conveying amount of the printing medium by measuring a rotational amount of said conveying means;

second measuring means for obtaining a conveying amount of the printing medium by directly detecting a moving amount of the printing medium; and control means for controlling said conveying means by using both of output values obtained from said first measuring means and said second measuring means, wherein said control means controls said conveying means based on a value obtained from said second measuring means when the printing is carried out in a rear end area of the printing medium.

10. A printing apparatus as defined by claim 9, wherein said first conveying means conveys the printing medium from said first conveyor roller toward said second conveyor roller, and the rear end area is defined as an area in which the printing head carries out the printing operation on the printing medium in a stage in which the printing medium leaves said first conveyor roller and is conveyed solely by said second conveyor roller.

11. A printing apparatus as defined by claim 10, wherein said second measuring means is placed between said first conveyor roller and said second conveyor roller.

12. A printing apparatus as defined by claim 11, wherein said second measuring means detects a moving amount of the printing medium from back side of the printing medium.

13. A printing apparatus as defined by claim 9, wherein said control means controls said conveying means based on a value obtained from said first measuring means when the printing on the printing medium has completed.

14. A printing apparatus for carrying printing on a printing medium by using a printing head, comprising:

conveying means for conveying the printing medium, said conveying means carrying out one conveying mode of a first conveying speed and another conveying mode of a second conveying speed which is lower than the first conveying speed, first measuring means for obtaining a conveying amount of the printing medium by measuring a rotational amount of said conveying means;

second measuring means for obtaining a conveying amount of the printing medium by directly measuring a moving amount of the printing medium; and control means for controlling said conveying means by using both output values obtained from said first measuring means and said second measuring means, wherein said control means controls said conveying means using the value obtained from said second measuring means when the printing medium is conveyed in a useful range of said second measuring means and is conveyed at said second conveying speed.

15. A printing apparatus as defined by claim 14, wherein said conveying means has a conveyor roller for conveying the printing medium in correspondence with the rotation thereof, and said first measuring means has means for detecting a rotational amount of said conveyor roller.

16. A printing apparatus as defined by claim 14, wherein said second measuring means is an optical sensor having a light receiving section formed of a plurality of one- or two-dimensionally arranged light-receiving elements for receiving light beams reflected from the printing medium.

17. A printing apparatus as defined by claim 16, wherein said light-receiving section is composed of CCD or CMOS.

18. A printing apparatus as defined by claim 14, wherein the measurement by said second conveying-amount measuring means is carried out at a constant time interval.

* * * * *